US005267510A

United States Patent [19]

Hartung et al.

[11] Patent Number: 5,267,510

[45] Date of Patent: Dec. 7, 1993

[54] MECHANISM FOR ACCURATE-REGISTER SHEET TRANSFER AND THE TRANSPORT OF SHEETS BETWEEN THE PRINTING UNITS OF A MULTI-COLOR PRINTING MACHINE

[75] Inventors: Georg Hartung, Seligenstadt; Helmut Schild, Frankfurt am Main, both of Fed. Rep. of Germany

[73] Assignee: MAN Roland Druckmaschinen AG, Fed. Rep. of Germany

[21] Appl. No.: 949,892

[22] Filed: Sep. 23, 1992

[30] Foreign Application Priority Data

Sep. 25, 1991 [DE] Fed. Rep. of Germany ..... 4131887

[51] Int. Cl.[5] ..... B41F 9/00

[52] U.S. Cl. ..... 101/142; 101/217; 101/409; 271/204; 271/206

[58] Field of Search ..... 101/142, 145, 144, 177, 101/182, 137, 140, 184, 185, 217, 218, 409; 271/204, 206

[56] References Cited

U.S. PATENT DOCUMENTS

| | | | |
|---|---|---|---|
| 2,771,838 | 11/1956 | Federwitz | 101/409 |
| 3,935,814 | 2/1976 | Wetsgerber | 101/409 |
| 4,765,239 | 8/1988 | Ciccone et al. | 101/142 |
| 4,967,656 | 11/1990 | Douglas et al. | 271/204 |
| 4,977,828 | 12/1990 | Douglas | 101/142 |
| 5,088,404 | 2/1992 | MacConnell et al. | 271/204 |

*Primary Examiner*—Eugene H. Eickholt
*Attorney, Agent, or Firm*—Leydig, Voit & Mayer

[57] ABSTRACT

A chain operated sheet transport and transfer mechanism for sheet-fed printing machines having a plurality of printing units. The chain operated mechanism includes a plurality of gripper cars affixed to chains for movement between the printing units. The gripper cars each have a gripper impact strip and a pivotable gripper finger, with the gripper strip of each car extending the width of the gripper car and being of concave configuration. A bending device at the transfer zone of each printing unit is operable for acting on the gripper car to bend the concave gripper impact strips straight in order that sheets are transferred from one printing unit to the other without register deviation.

11 Claims, 5 Drawing Sheets

MECHANISM FOR ACCURATE-REGISTER SHEET TRANSFER AND THE TRANSPORT OF SHEETS BETWEEN THE PRINTING UNITS OF A MULTI-COLOR PRINTING MACHINE

FIELD OF THE INVENTION

The present invention relates to a mechanism for accurate-register sheet transfer and for the transport of sheets between the printing units of a multi-color printing machine.

BACKGROUND OF THE INVENTION

The transport of sheets and sheet transfer in multicolor sheet printing machines by means of gripper cars and endless chains is known, as disclosed in German patent DE 3 636 578 A1. During the sheet transfer operation, as the gripper cars proceed around the wheels about which the chains are trained, the gripper cars experience a flexure as a result of centrifugal force dependent on the printing speed. Gripper car locking devices, such as shown in German patent DE-AS 1 224 753, obviate the centrifugal force effects on the gripper car by means of a plurality of hooks which connect the gripper car rigidly to the chain wheel shaft during the transfer period. Such locking devices, however, require a complex control mechanism in order to achieve the opening and closing movements.

In order to prevent the effect of flexure of the gripper cars during their deflection as they proceed about the chain wheels, it also is know from German patent DE-PS 2 157 993 to reduce the heights of the gripper supports over the width of the gripper car, continuously from the outside towards the middle, in accordance with the bending line. In such devices, care is taken to ensure that the differences in the heights of the gripper supports are designed to correspond to the bending line at maximum centrifugal force. Since the gripper supports lie on a straight line only at that centrifugal force, the sheet is subject to varying distortion in the transfer position at other speeds so that register problems still may occur and must be corrected.

Numerous publications disclose means for register correction or for the alignment of distorted sheets by means of adjustable bending devices. The bending devices, in accordance with German patent DE-PS 3 112 964, for example, relate generally to sheet transfer drums such as sheet feed and run-over drums. In the case of sheet transfer drums, a gripper carrier is pivotable relative to rotary movement of the drum, the position of a middle gripper carrier bearing being established by the instantaneous rotary position of an adjustable control cam mechanism comprising an outer cam on a control shaft and a biasing roller running against the outer cam with pre-stressing.

In German patent DE-Gbm 8 816 641, the bending devices also relate to an oscillating gripper, the bending devices consisting of an adjustable abutment which is fixed with respect to the side column of the press and against which a gripper carrier bears approximately centrally before the ends of the gripper carrier have reached their zero position, in which the grippers take over the sheet.

Finally, in German patent DE-OS 3 823 846, the bending devices relate to a sheet guide cylinder which comprises a non-rotating cross-member in the region of the cylinder mountings and which, in the central axial zone of the cylinder member, there is provided an adjustable support bearing that is mounted eccentrically in relation to the cross-member, the latter being rotatable and lockable on the frame so that the required flexure of the cylinder can be achieved by the adjustable middle support bearing.

The known bending devices thus relate to drum transfer systems and oscillating or auxiliary grippers, but not to chain transfer systems.

OBJECTS AND SUMMARY OF THE INVENTION

It is an object of the present invention to provide a chain operated sheet transfer and transport system that ensures accurate register of the printed sheets during a transfer operation.

Another object is to provide a sheet transfer system as characterized above that is relatively simple in construction and lends itself to economical manufacture and reliable operation.

Other objects and advantages of the invention will become apparent upon reading the following detailed description and upon reference to the drawings, in which:

Figure 1:
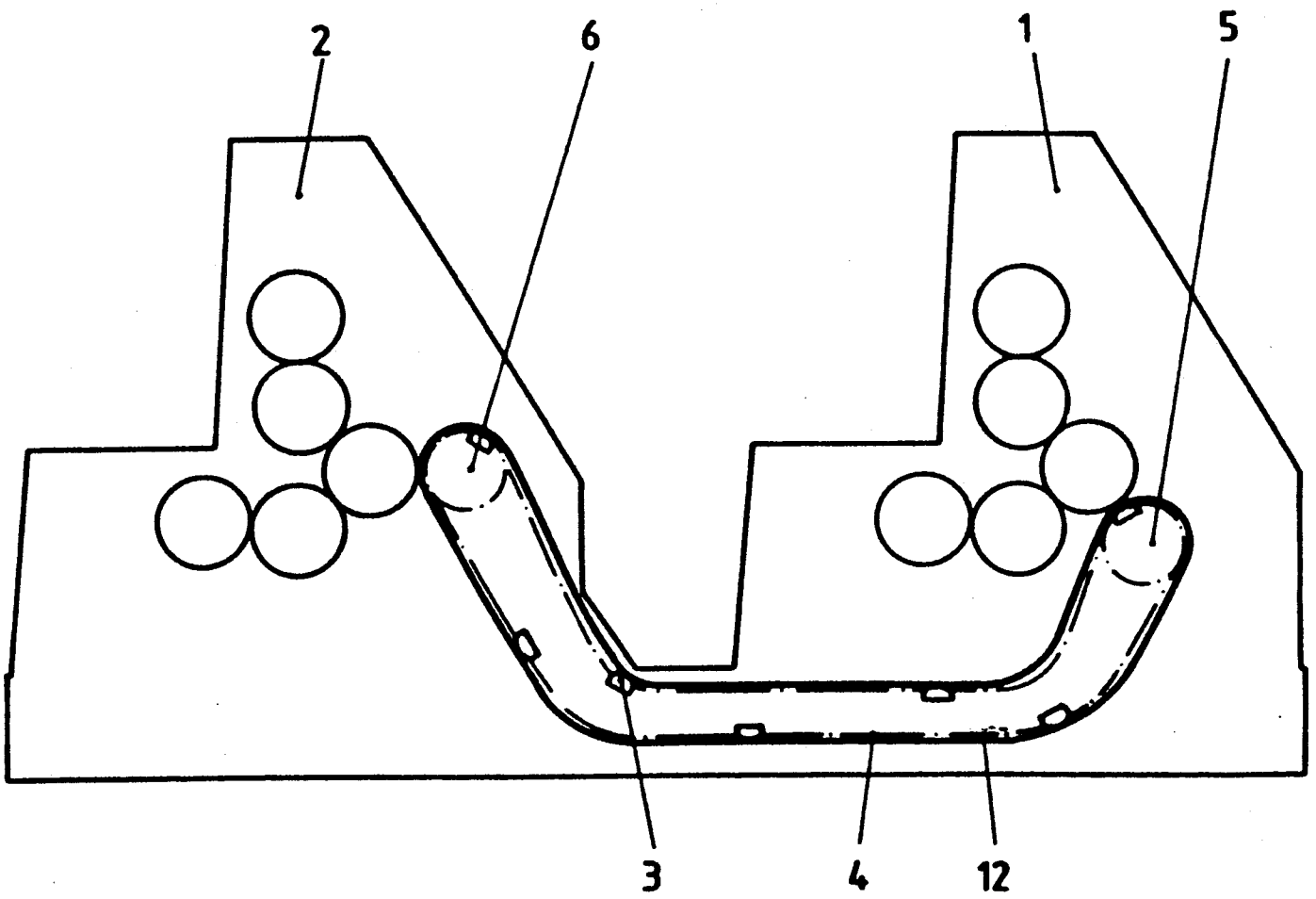
FIG. 1 is a partially diagrammatic side elevational view of a printing press having a plurality of printing units with a chain operated sheet transfer and transport system in accordance with the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENT

Referring now more particularly to the drawings, there is shown an illustrative sheet-fed printing press having a chain operated sheet transfer and transport system in accordance with the present invention. The printing press comprises a plurality of printing units 1, 2 each having plate blanket and impression cylinders of a conventional type.

Figure 3:
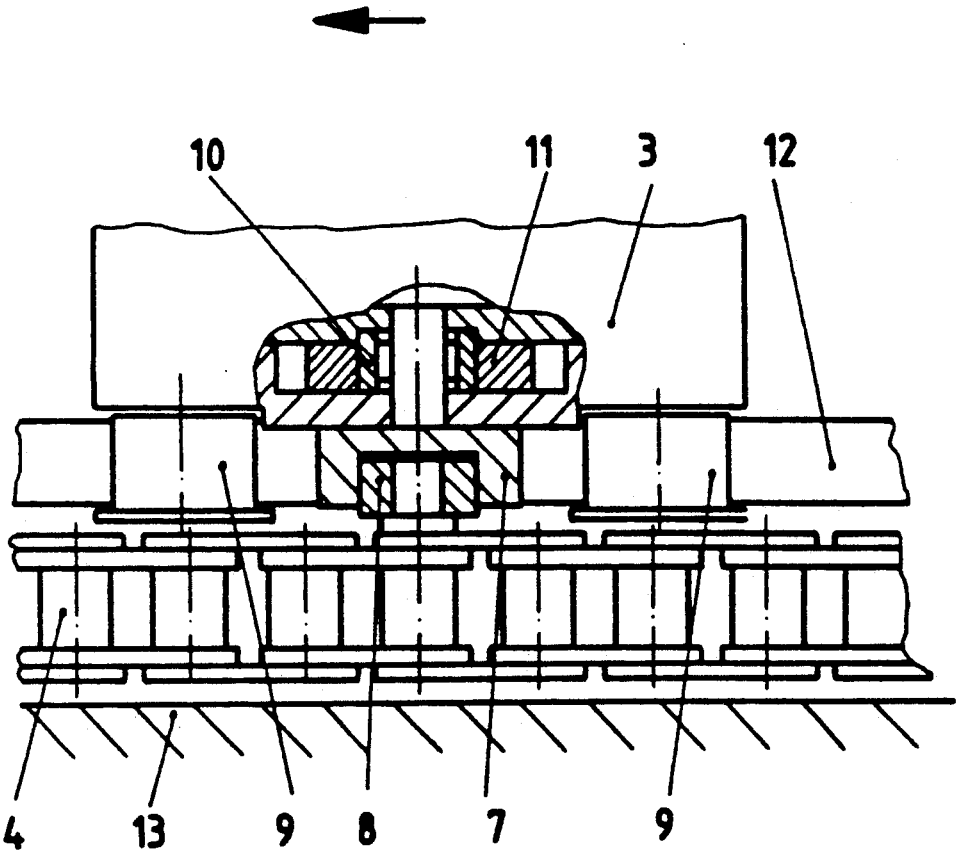
FIG. 3 is an enlarged partial section showing the connection of the gripper car with the link chain.
Figure 4:
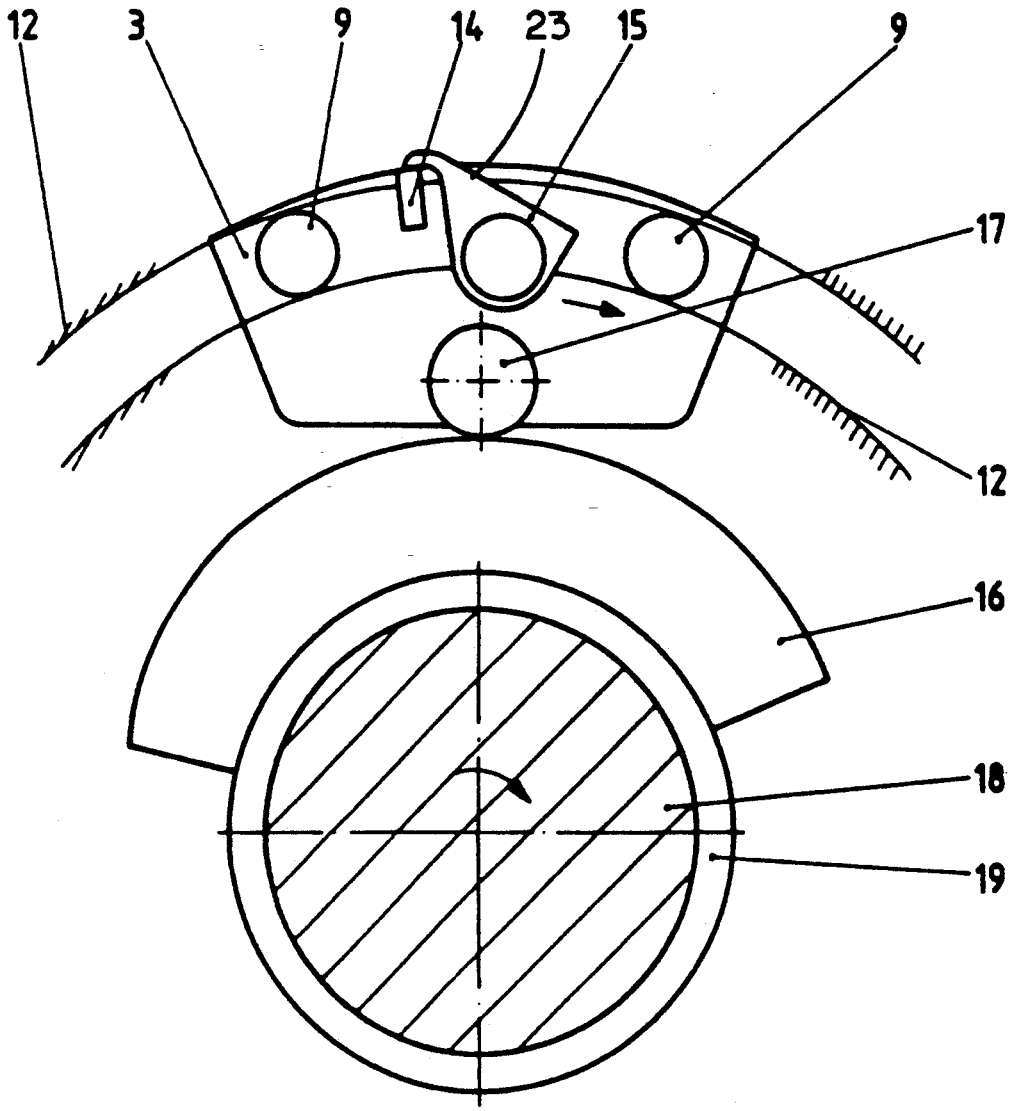
FIG. 4 shows the gripper car proceeding through the sheet transfer zone of the feed drum.
Figure 5:
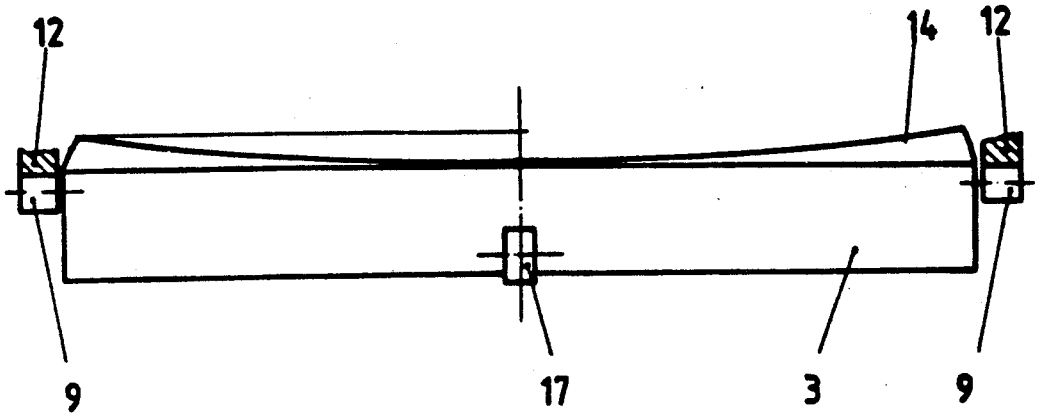
FIG. 5 is a diagrammatic depiction of the gripper car in a non-flexed sheet transport condition.
Figure 6:
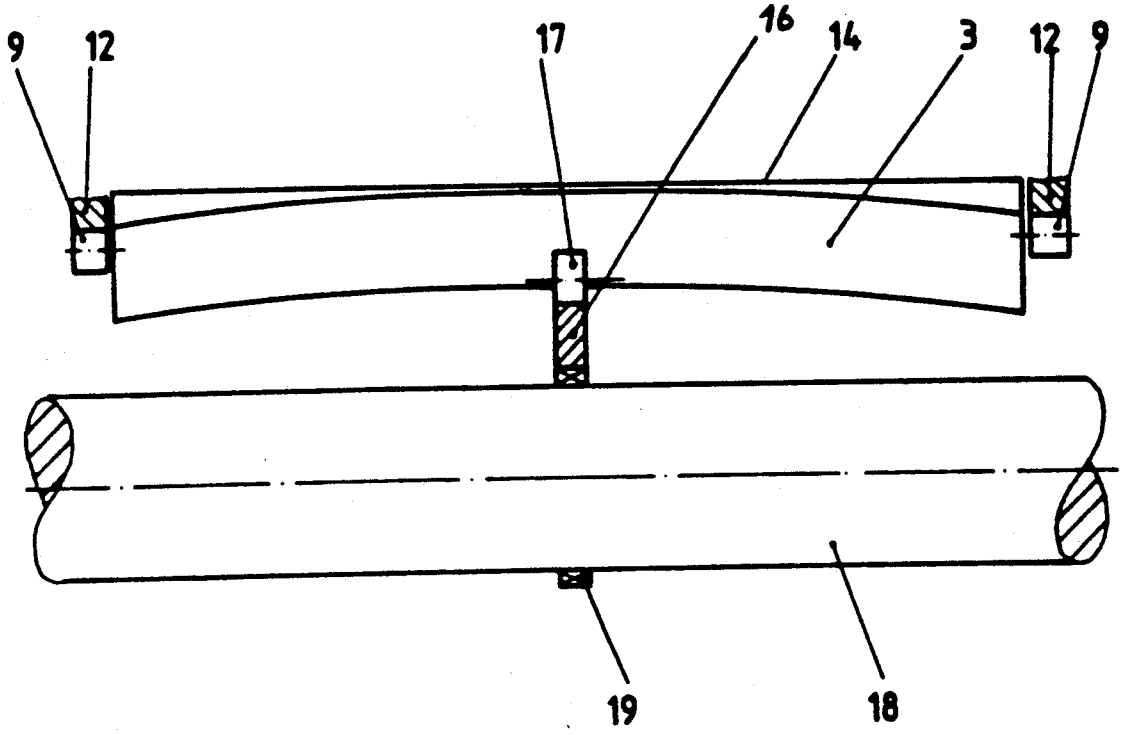
FIG. 6 is a diagrammatic depiction of the gripper car in a flexed condition as it is proceeding through a sheet transfer zone.

The sheet transfer system includes endless chains 4 which are trained in a known manner between a takeoff drum or wheel 5 in the first printing unit 1 and a feed drum or wheel 6 in the second printing unit 2. The chains 4 each carry gripper cars or carriages 3 which are guided on rails 12 during movement with the driven chains 4. The illustrated gripper cars have rollers 9 for riding in the guide rails 12 and are supported by the chains 4 by means of carrier links 7 and a drive roll 8, as depicted in FIG. 3. The gripper cars 3 each comprise a gripper impact strip or support 14 carried for movement with the chain links 7and a gripper finger 23 supported by a rod 15 for pivotal movement between a clamping position in which the end of the sheet is interposed between the impact strip 14 and a sheet releasing position pivotally removed from the impact strip 14.

Figure 2:
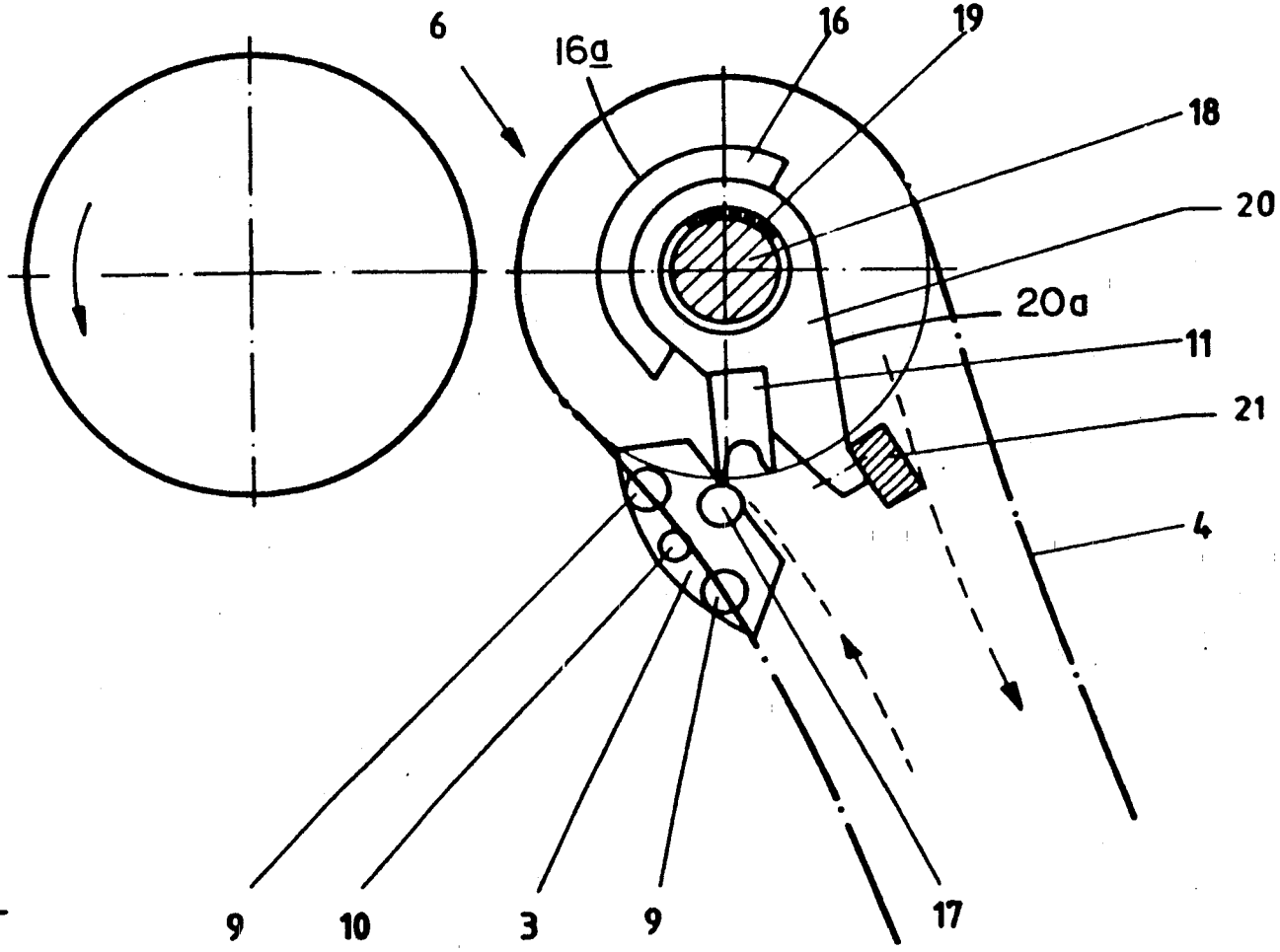
FIG. 2 is an enlarged fragmentary section of a feed drum of the train transfer system showing a chain operated gripper car approaching the sheet transfer zone.

As the gripper car 3 approaches a sheet transfer zone, such as in the region of the feed drum 6 depicted in FIG. 2, catcher forks 11 rigidly connected to the feed drum 6 for rotation therewith engage a roller 10 carried by the gripper car 2 to properly align the gripper car 3 for sheet transfer. The catcher forks 11 preferably are mounted for adjustable radial and angular alignment with respect to the gripper car 3.

In accordance with the invention, the gripper impact strip 14 of each gripper car has a concave construction over the width of the gripper car such that if given the maximum centrifugal force the gripper impact strip experiences during passage around the feed drum and through the sheet transfer zone the impact strip 14, without the application of external force, always has a concave configuration, decreasing in height continuously from the opposite ends of the strip to the center. In other words, at maximum speed of the chain sheet transfer system, and hence at the maximum centrifugal force the gripper impact strip 14 experiences during a sheet transfer operation, without the application of external forces, the gripper impact strip always has a concave shape.

In carrying out the invention, impact strip bending means are provided on the rotating drum at the sheet transfer station for mechanically bending the concave gripper impact strip into a straight co-planar condition for enabling the sheet to be engaged and transferred with correct register alignment. In the illustrated embodiment, the mechanical bending means comprises an outer cam 16 mounted on the end of the take-off and feed drums 5, 6 and which has a curved segment 6*a* against which a central biasing roller 17 mounted on the gripper car 3 runs while in the sheet transfer zone. As the gripper car is guided on the rails 12 around the take-off and feed drums 5, 6, the biasing roller 17 in cooperation with the cam 16 causes the gripper car to flex outwardly in the middle into a predetermined straight prestressed condition. The radially and angularly adjustable catcher forks engage the prestressed gripper car 3 at the location of the cam roller 10 and press it outwardly so that the rollers 9 of the gripper car are pressed against the rail 12 with additional pressure so as to enable the gripper car 3 to move through the sheet transfer zone smoothly.

The cam 16 in this case is secured on a flange 20 which is mounted on a shaft 18 of the chain wheel by means of a rolling bearing 19 so as to permit relative rotational movement of the shaft 18, as depicted in FIG. 2. The flange 20 has an arm 20*a* which is connected to a tie rod 21 extending parallel to the drum axis. The rod 21 is thus fixed to the outer cam 16 while one end thereof may be fixed to a side column 13 of the press.

The outer cam 16 may have a configuration in the peripheral direction such as to give a soft bending force build up and decline to the gripper impact strip 14 of each gripper car 3 as it proceeds through the sheet transfer zone. The outer cam 16 preferably has a lower starting zone followed by the actual support and impact strip deflection zone which are designed in a generally circular fashion. The maximum force applied by the cam 16 to the gripper impact 14 is in the region of the sheet transfer. The bending force required for this can be determined mathematically or by measurement, taking into account the flexure of the chain wheel shaft 18. As indicated previously, the gripper impact strip 14 is designed with such concavity that even the maximum centrifugal force it will not bend the gripper impact strip 14 completely straight, which can only be done by the cam 16. As a result, the force of the cam 16 on the gripper impact strip 14 decreases with increasing speed because of the stress relief due to the centrifugal force, and hence, the same applies to the pressure in the mountings of the rollers 10, and 17 of the gripper car 3. Moreover, due to the engagement of the catcher forks 11 with the cam rollers 10 during the sheet transfer operation vibrations are dampened in the radial and tangential directions when the gripper impact strip is bent into its straight condition so as to enable the sheet to be transferred with the correct register alignment.

From the foregoing, it can be seen that the chain operated sheet transfer and transport system of the present invention ensures accurate register of the printed sheets during sheet transfer operations. Moreover, the sheet transfer system is relatively simple in construction and lends itself to economical manufacture and reliable operation.

What is claimed is:

1. A sheet-fed printing machine for multicolorprinting comprising a plurality of printing units, a sheet transport and transfer mechanism including chains that are trained about chain wheels at sheet transfer zones of the printing units, a plurality of gripper cars fixed to said chains for movement with said chains between said printing units, guide rails associated with said chains for guiding movement of said chains and the gripper cars affixed thereto, said gripper cars each having a gripper impact strip and a pivotable gripper finger for cooperation with said impact strip, said impact strip of each gripper car extending the width of the gripper car and being of concave configuration heightwise, a bending device at the transfer zone of each printing unit, said bending device each being operable for acting on the gripper car in the middle thereof for pressing the gripper car against said guide rails such that the impact strip of each gripper car is bent straight while at said transfer zone.

2. The printing machine of claim 1 in which said bending device includes a cam mounted on the chain wheel in the region of said transfer zone over which said gripper cars pass during a sheet transfer.

3. The printing machine of claim 2 in which said gripper cars have rollers which ride on said guide rails.

4. The printing machine of claim 3 in which said chains include carrier links upon which said gripper cars are supported.

5. The printing machine of claim 2 in which each said gripper car has a biasing roller which runs on said cam to produce bending forces on said gripper car impact strip while at said transfer zone.

6. The printing machine of claim 2 in which each said chain wheel has a shaft upon which said cam is mounted.

7. The printing machine of claim 2 including a frame, and said cam is locked in selected position by means of a transverse rod affixed to said frame.

8. The printing machine of claim 5 in which said cam has a starting zone over which said biasing roller runs prior to reaching a sheet transfer position.

9. A mechanism for accurate-register sheet transfer and for transport of sheets between printing units of a multi-color printing machine comprising chains that are trained about chain wheels at sheet transfer zones of the printing units, a plurality of gripper cars fixed to said chains for movement with said chains between said printing units, guide rails associated with said chains for guiding movement of said chains and the gripper cars affixed thereto, said gripper cars each having a gripper impact strip and a pivotable gripper finger for cooperation with said impact strip, said impact strip of each gripper car extending the width of the gripper car and having a concave configuration with the height of the strip progressively reducing toward the middle, a bending device at the transfer zone of each printing unit, said bending device each being operable for acting on the gripper car in the middle thereof for pressing the gripper car against said guide rails such that the impact strip of each gripper car is bent straight while at said transfer zone.

10. The printing machine of claim 9 in which said bending device includes a cam mounted on the chain wheel in the region of said transfer zone over which said gripper cars pass during a sheet transfer.

11. The printing machine of claim 10 in which each said chain wheel has a shaft upon which said cam is mounted.

* * * * *